US008051861B2

(12) United States Patent
Field et al.

(10) Patent No.: US 8,051,861 B2
(45) **Date of Patent: *Nov. 8, 2011**

(54) CLEANING SYSTEM UTILIZING PURIFIED WATER

(75) Inventors: Bruce F. Field, Golden Valley, MN (US); Hans C. Killingstad, Orono, MN (US)

(73) Assignee: Tennant Company, Minneapolis, MN (US)

( * ) Notice: Subject to any disclaimer, the term of this patent is extended or adjusted under 35 U.S.C. 154(b) by 1115 days.

This patent is subject to a terminal disclaimer.

(21) Appl. No.: 11/331,845

(22) Filed: Jan. 13, 2006

(65) Prior Publication Data

US 2006/0137127 A1 Jun. 29, 2006

Related U.S. Application Data

(63) Continuation-in-part of application No. 10/152,549, filed on May 21, 2002, now Pat. No. 7,051,399, which is a continuation-in-part of application No. 10/026,411, filed on Dec. 21, 2001, now Pat. No. 6,585,827, application No. 11/331,845, which is a continuation-in-part of application No. 10/653,347, filed on Sep. 2, 2003, now abandoned, which is a continuation-in-part of application No. 10/328,516, filed on Dec. 23, 2002, now Pat. No. 6,705,332, and a continuation-in-part of application No. 10/152,537, filed on May 21, 2002, now Pat. No. 6,671,925, and a continuation-in-part of application No. 10/143,582, filed on May 9, 2002, now Pat. No. 6,735,811, which is a continuation-in-part of application No. 10/026,411, filed on Dec. 21, 2001, now Pat. No. 6,585,827.

(60) Provisional application No. 60/643,933, filed on Jan. 13, 2005, provisional application No. 60/308,773, filed on Jul. 30, 2001.

(51) Int. Cl.
*B08B 3/00* (2006.01)

(52) U.S. Cl. ..... 134/60; 134/10; 15/3; 15/300.1; 15/320

(58) Field of Classification Search ..... None
See application file for complete search history.

(56) References Cited

U.S. PATENT DOCUMENTS 2,563,151 A 8/1951 Bjorksten ..... 134/111

(Continued)

FOREIGN PATENT DOCUMENTS

EP 0 744 148 A2 11/1996

(Continued)

OTHER PUBLICATIONS

"Treatment Systems for Household Water Supplies: Iron and Manganese Removal", Seelig et al., North Dakota State University Agriculture and University Extension, Publication AE-1030, Feb. 1992, retrieved from http://www.ag.ndsu.edu/pubs/h2oqual/watsys/ae1030w.htm on Mar. 25, 2011.*

(Continued)

*Primary Examiner* — Michael Kornakov
*Assistant Examiner* — Eric Golightly
(74) *Attorney, Agent, or Firm* — Westman, Champlin & Kelly, P.A.

(57) ABSTRACT

A cleaning system includes a supply of purified water, a supply of cleaning agent, a mixing junction, and a distributor. The mixing junction is configured to combine a flow of the purified water and a flow of the cleaning agent and output a flow of cleaning liquid comprising the flows of the purified water and the cleaning agent. The distributor includes an output through which the cleaning liquid can be discharged. In a method of cleaning a surface, flows of purified water and cleaning agent are provided. The flow of purified water and the flow of cleaning agent are mixed to form a flow of cleaning liquid. The flow of cleaning liquid is then discharged to the surface.

18 Claims, 6 Drawing Sheets

U.S. PATENT DOCUMENTS

| | | | | | |
|---|---|---|---|---|---|
| 2,731,659 | A | | 12/1952 | Coplen | 15/320 |
| 3,037,887 | A | | 5/1959 | Brenner et al. | 134/22 |
| 2,941,729 | A | * | 6/1960 | Goodrie | 239/428.5 |
| 2,993,494 | A | | 7/1961 | Svensson | 134/169 |
| 3,078,190 | A | | 2/1963 | Blaser et al. | 134/10 |
| 3,162,427 | A | | 12/1964 | Knudson et al. | 259/4 |
| 3,207,165 | A | * | 9/1965 | Durrant | 134/58 R |
| 3,212,762 | A | | 10/1965 | Carroll et al. | 261/124 |
| 3,231,134 | A | | 1/1966 | Webster | 222/1 |
| 3,392,418 | A | | 7/1968 | Schowalter | 15/320 |
| 3,412,941 | A | * | 11/1968 | Steinback | 239/581.1 |
| 3,436,262 | A | | 4/1969 | Crowe et al. | 134/10 |
| 3,453,678 | A | | 7/1969 | Gehman et al. | 15/50 |
| 3,456,279 | A | | 7/1969 | Koland | 15/320 |
| 3,460,717 | A | | 8/1969 | Thomas | 15/320 |
| 3,490,948 | A | | 1/1970 | Farison | 134/36 |
| 3,533,559 | A | * | 10/1970 | Caird | 239/419.5 |
| 3,535,162 | A | | 10/1970 | Bray et al. | 134/42 |
| 3,549,420 | A | | 12/1970 | Cunningham | 134/22 |
| 3,655,096 | A | | 4/1972 | Easter | 222/82 |
| 3,676,889 | A | | 7/1972 | Edlin | 15/320 |
| 3,761,987 | A | | 10/1973 | Nayfa et al. | 15/50 |
| 3,774,262 | A | | 11/1973 | Anthony et al. | 15/322 |
| 3,789,449 | A | | 2/1974 | MacFarland et al. | 15/4 |
| 3,823,727 | A | | 7/1974 | Fry | 137/88 |
| 3,931,662 | A | | 1/1976 | Nayfa et al. | 15/320 |
| 3,938,212 | A | | 2/1976 | Krier et al. | 15/50 |
| 3,940,826 | A | | 3/1976 | Phillips et al. | 15/320 |
| 3,942,218 | A | | 3/1976 | Krier et al. | 15/340 |
| 3,974,541 | A | | 8/1976 | Silvis et al. | 15/320 |
| 3,979,789 | A | | 9/1976 | Peabody et al. | 15/349 |
| 4,000,536 | A | | 1/1977 | Nayfa et al. | 15/50 |
| 4,014,808 | A | | 3/1977 | Herpers, Jr. et al. | 252/135 |
| 4,032,307 | A | | 6/1977 | Sommerfeld | 55/96 |
| 4,037,289 | A | | 7/1977 | Dojan | 15/320 |
| D245,994 | S | | 10/1977 | Olson | D23/162 |
| 4,061,001 | A | | 12/1977 | Von der Eltz et al. | 68/200 |
| 4,096,084 | A | | 6/1978 | Thomsen et al. | 252/173 |
| 4,099,285 | A | | 7/1978 | Christensen et al. | 15/83 |
| 4,107,075 | A | | 8/1978 | Kramer | 252/359 |
| 4,133,773 | A | | 1/1979 | Simmons | 252/359 |
| 4,138,756 | A | | 2/1979 | Krier et al. | 15/83 |
| RE29,957 | E | | 4/1979 | Kasper | 15/83 |
| 4,167,798 | A | | 9/1979 | Kltigl et al. | 15/320 |
| 4,167,799 | A | | 9/1979 | Webb | 15/320 |
| 4,173,056 | A | | 11/1979 | Geyer | 15/320 |
| 4,191,590 | A | | 3/1980 | Sundheim | 134/21 |
| 4,194,263 | A | | 3/1980 | Herpers et al. | 15/353 |
| 4,206,530 | A | | 6/1980 | Kroll et al. | 15/340 |
| 4,210,978 | A | | 7/1980 | Johnson et al. | 15/320 |
| D257,845 | S | | 1/1981 | Peabody et al. | D15/50 |
| 4,258,451 | A | | 3/1981 | Sommerfeld | 15/352 |
| 4,262,382 | A | | 4/1981 | Brown et al. | 15/49 |
| 4,295,244 | A | | 10/1981 | Herpers et al. | 15/320 |
| 4,310,944 | A | | 1/1982 | Kroll et al. | 15/346 |
| 4,320,556 | A | | 3/1982 | Kimzey et al. | 15/347 |
| 4,334,335 | A | | 6/1982 | Brown et al. | 15/319 |
| 4,345,353 | A | | 8/1982 | Sommerfeld | 15/349 |
| 4,346,494 | A | | 8/1982 | Peabody et al. | 15/179 |
| 4,348,783 | A | | 9/1982 | Swanson et al. | 15/320 |
| 4,355,435 | A | | 10/1982 | Kimzey et al. | 15/347 |
| 4,365,189 | A | | 12/1982 | Hawkins et al. | 318/284 |
| 4,369,544 | A | | 1/1983 | Parisi | 15/320 |
| D267,824 | S | | 2/1983 | Mannelly | D32/16 |
| 4,373,227 | A | | 2/1983 | Kimzey et al. | 15/347 |
| 4,377,017 | A | | 3/1983 | Herpers et al. | 15/320 |
| 4,378,855 | A | | 4/1983 | Haub et al. | 180/65 |
| 4,393,538 | A | | 7/1983 | Olson | 15/320 |
| 4,419,141 | A | | 12/1983 | Kunkel | 134/22.12 |
| 4,429,432 | A | | 2/1984 | Copeland et al. | 15/320 |
| D273,620 | S | | 4/1984 | Kimzey et al. | D32/16 |
| D273,621 | S | | 4/1984 | Haub et al. | D32/16 |
| D273,622 | S | | 4/1984 | Brown et al. | D32/16 |
| 4,457,036 | A | | 7/1984 | Carlson et al. | 15/49 |
| 4,511,486 | A | | 4/1985 | Shah | 252/90 |
| 4,557,739 | A | | 12/1985 | Fortman et al. | 55/320 |
| 4,570,856 | A | | 2/1986 | Groth et al. | 239/310 |
| 4,571,771 | A | | 2/1986 | Worwa | 15/319 |
| 4,580,313 | A | | 4/1986 | Blehert | 15/349 |
| 4,586,208 | A | | 5/1986 | Trevarthen | 8/158 |
| 4,595,420 | A | | 6/1986 | Williams, III et al. | 134/6 |
| 4,608,086 | A | | 8/1986 | Dodge | 106/12 |
| 4,615,070 | A | | 10/1986 | Frederick et al. | 15/339 |
| 4,624,026 | A | | 11/1986 | Olson et al. | 15/340 |
| 4,634,403 | A | | 1/1987 | Peabody et al. | 474/1 |
| 4,667,364 | A | | 5/1987 | Meili | 15/320 |
| 4,675,935 | A | | 6/1987 | Kasper et al. | 15/319 |
| 4,676,287 | A | | 6/1987 | Fitzwater | 141/285 |
| 4,676,926 | A | | 6/1987 | Kappler | 252/307 |
| 4,679,271 | A | | 7/1987 | Field et al. | 15/49 |
| 4,709,771 | A | | 12/1987 | Basham et al. | 180/6.5 |
| 4,729,141 | A | | 3/1988 | Berg et al. | 15/49 |
| 4,757,566 | A | | 7/1988 | Field et al. | 15/49 |
| 4,768,311 | A | | 9/1988 | Olson | 51/174 |
| 4,780,243 | A | | 10/1988 | Edgley et al. | 252/307 |
| 4,805,256 | A | | 2/1989 | Mason et al. | 15/320 |
| 4,805,258 | A | | 2/1989 | Sitarski et al. | 15/385 |
| 4,817,233 | A | | 4/1989 | Waldhauser | 15/320 |
| 4,819,676 | A | | 4/1989 | Blehert et al. | 134/21 |
| 4,822,431 | A | | 4/1989 | Bricher et al. | 134/28 |
| 4,838,457 | A | | 6/1989 | Swahl et al. | 222/48 |
| 4,849,027 | A | | 7/1989 | Simmons | 134/22.18 |
| 4,866,804 | A | | 9/1989 | Masbruch et al. | 15/49 |
| 4,881,288 | A | | 11/1989 | May et al. | 15/98 |
| 4,903,718 | A | | 2/1990 | Sullivan | 134/184 |
| 4,913,316 | A | | 4/1990 | Richter | 221/1 |
| 4,967,064 | A | | 10/1990 | Field et al. | 250/203.2 |
| 4,974,618 | A | | 12/1990 | Nysted | 134/21 |
| 4,986,378 | A | | 1/1991 | Kasper | 180/6.48 |
| 4,996,468 | A | | 2/1991 | Field et al. | 318/587 |
| 5,013,333 | A | | 5/1991 | Beaufoy et al. | 55/21 |
| 5,016,310 | A | | 5/1991 | Geyer et al. | 15/49.1 |
| 5,031,837 | A | | 7/1991 | Hanish | 239/267 |
| 5,044,043 | A | | 9/1991 | Basham et al. | 15/319 |
| 5,045,118 | A | | 9/1991 | Mason et al. | 134/21 |
| 5,060,342 | A | | 10/1991 | Brazier | 15/322 |
| 5,064,010 | A | | 11/1991 | Mashbruch et al. | 180/6.5 |
| 5,088,149 | A | | 2/1992 | Berg et al. | 15/322 |
| 5,093,955 | A | | 3/1992 | Blehert et al. | 15/320 |
| RE33,926 | E | | 5/1992 | Waldhauser | 15/320 |
| 5,116,425 | A | | 5/1992 | Ruef | 134/17 |
| 5,133,107 | A | | 7/1992 | MacDonald | 15/50.3 |
| 5,207,642 | A | | 5/1993 | Orkin et al. | 604/65 |
| 5,212,848 | A | | 5/1993 | Geyer | 15/401 |
| 5,213,120 | A | | 5/1993 | Dickson | 134/102.1 |
| 5,231,725 | A | | 8/1993 | Hennessey et al. | 15/83 |
| 5,244,003 | A | | 9/1993 | Boomgaarden | 137/1 |
| 5,254,146 | A | | 10/1993 | Beaufoy | 55/320 |
| 5,276,933 | A | | 1/1994 | Hennessey et al. | 15/83 |
| 5,295,277 | A | | 3/1994 | Koenigs et al. | 15/83 |
| 5,303,448 | A | | 4/1994 | Hennessey et al. | 15/340.3 |
| 5,319,828 | A | | 6/1994 | Waldhauser et al. | 15/320 |
| 5,383,605 | A | | 1/1995 | Teague | 239/526 |
| RE35,033 | E | | 9/1995 | Waldhauser | 15/320 |
| 5,455,985 | A | | 10/1995 | Hamline et al. | 15/401 |
| 5,462,607 | A | | 10/1995 | Mestetsky et al. | 134/22.12 |
| 5,483,718 | A | | 1/1996 | Blehert et al. | 15/50.3 |
| 5,509,972 | A | | 4/1996 | Akazawa et al. | 134/26 |
| 5,515,568 | A | | 5/1996 | Larson et al. | 15/50.3 |
| 5,526,547 | A | | 6/1996 | Williams et al. | 15/320 |
| 5,566,422 | A | | 10/1996 | Geyer | 15/320 |
| 5,593,091 | A | | 1/1997 | Harris | 239/127 |
| 5,647,093 | A | | 7/1997 | Engel et al. | 15/352 |
| 5,649,643 | A | | 7/1997 | Ridgeway | 222/105 |
| 5,659,921 | A | | 8/1997 | Narayan | 15/349 |
| 5,711,775 | A | | 1/1998 | Field et al. | 55/273 |
| 5,735,017 | A | | 4/1998 | Barnes et al. | 15/321 |
| 5,738,248 | A | | 4/1998 | Green | 222/129.2 |
| 5,813,086 | A | | 9/1998 | Ueno et al. | 15/320 |
| 5,816,298 | A | | 10/1998 | Stricklin et al. | 141/346 |
| 5,829,094 | A | | 11/1998 | Field et al. | 15/352 |
| 5,836,045 | A | | 11/1998 | Anthony et al. | 15/320 |
| 5,853,814 | A | | 12/1998 | Murphy | 427/434.6 |
| 5,871,152 | A | | 2/1999 | Saney | 239/8 |
| 5,884,353 | A | | 3/1999 | Berg et al. | 15/83 |
| 5,893,189 | A | | 4/1999 | D'Costa | 15/83 |
| 5,901,407 | A | | 5/1999 | Boomgaarden | 15/320 |

| | | | | |
|---|---|---|---|---|
| 5,940,928 | A | 8/1999 | Erko | 15/319 |
| 5,940,929 | A | 8/1999 | Berg | 15/334 |
| 5,943,724 | A | 8/1999 | Erko et al. | 15/49.1 |
| 5,943,730 | A | 8/1999 | Boomgaarden | 15/320 |
| 5,967,747 | A | 10/1999 | Burke et al. | 415/206 |
| 5,983,447 | A | 11/1999 | Boomgaarden | 15/354 |
| 5,991,953 | A | 11/1999 | Durenberger et al. | 15/83 |
| 5,996,173 | A | 12/1999 | Engel et al. | 15/352 |
| 5,996,174 | A | 12/1999 | Boomgaarden et al. | 15/354 |
| 6,003,186 | A | 12/1999 | Larson | 15/82 |
| 6,017,163 | A | 1/2000 | Keppers | 401/48 |
| 6,018,844 | A | 2/2000 | Basham et al. | 15/349 |
| 6,035,479 | A | 3/2000 | Basham et al. | 15/83 |
| 6,073,295 | A | 6/2000 | Durenberger et al. | 15/83 |
| 6,090,217 | A | 7/2000 | Kittle | 134/11 |
| 6,092,261 | A | 7/2000 | Boomgaarden | 15/323 |
| 6,117,200 | A | 9/2000 | Berg et al. | 55/287 |
| 6,125,495 | A | 10/2000 | Berg et al. | 15/183 |
| 6,131,766 | A | 10/2000 | King et al. | 222/1 |
| 6,192,542 | B1 | 2/2001 | Frederick et al. | 15/84 |
| 6,202,243 | B1 | 3/2001 | Beaufoy et al. | 15/49.1 |
| 6,206,980 | B1 | 3/2001 | Robinson | 134/21 |
| 6,209,756 | B1 | 4/2001 | Van Der Heijden | 222/105 |
| 6,249,926 | B1 | 6/2001 | Wulff | 15/50.1 |
| 6,276,613 | B1 | 8/2001 | Kramer | 239/304 |
| 6,283,221 | B2 | 9/2001 | Hurray et al. | 169/30 |
| 6,286,169 | B1 | 9/2001 | D'Costa et al. | 15/52.1 |
| 6,389,641 | B1 | 5/2002 | Boomgaarden et al. | 15/340.1 |
| 6,398,829 | B1 | 6/2002 | Shinler et al. | 55/317 |
| 6,401,294 | B2 | 6/2002 | Kasper | 15/320 |
| 6,418,586 | B2 | 7/2002 | Fulghum | 15/320 |
| 6,421,870 | B1 | 7/2002 | Basham et al. | 15/83 |
| 6,425,958 | B1 | 7/2002 | Giddings et al. | 134/21 |
| 6,428,590 | B1 | 8/2002 | Lehman et al. | 55/334 |
| 6,449,793 | B2 | 9/2002 | D'Costa et al. | 15/52.1 |
| 6,505,379 | B2 | 1/2003 | Keller | 15/339 |
| 6,507,968 | B1 | 1/2003 | Hansen | 15/49.1 |
| 6,523,992 | B1 | 2/2003 | Bublewitz et al. | 366/172.1 |
| 6,530,102 | B1 | 3/2003 | Pierce et al. | 15/52.1 |
| 6,543,580 | B1 | 4/2003 | Gathmann et al. | 184/7.4 |
| 6,585,827 | B2 | 7/2003 | Field et al. | 134/6 |
| 6,602,018 | B2 | 8/2003 | Feeny et al. | 403/227 |
| 6,614,195 | B2 | 9/2003 | Bushey et al. | 318/135 |
| 6,618,888 | B2 | 9/2003 | Joynt et al. | 15/49.1 |
| 6,644,510 | B2 | 11/2003 | Kawolics et al. | 222/105 |
| 6,647,585 | B1 | 11/2003 | Robinson | 15/322 |
| 6,651,286 | B2 | 11/2003 | Pierce | 15/98 |
| 6,662,402 | B2 | 12/2003 | Giddings et al. | 15/320 |
| 6,662,600 | B1 | 12/2003 | Field et al. | 68/17 |
| D485,175 | S | 1/2004 | Field et al. | D9/432 |
| 6,671,925 | B2 | 1/2004 | Field et al. | 15/320 |
| 6,705,332 | B2 | 3/2004 | Field et al. | 134/102.1 |
| 6,706,142 | B2 | 3/2004 | Savas et al. | 156/345.48 |
| 6,735,811 | B2 | 5/2004 | Field et al. | 15/320 |
| 6,735,812 | B2 | 5/2004 | Hekman et al. | 15/320 |
| 6,742,219 | B2 | 6/2004 | Lenzmeier et al. | 15/345 |
| 6,802,098 | B2 | 10/2004 | Geyer et al. | 15/52.1 |
| 6,836,919 | B2 | 1/2005 | Shinler | 15/78 |
| 6,877,180 | B2 | 4/2005 | Wilmo et al. | 15/83 |
| 6,945,261 | B2 | 9/2005 | Wadsworth et al. | 134/95.3 |
| 2003/0019071 | A1 | 1/2003 | Field et al. | 15/320 |
| 2004/0040102 | A1 | 3/2004 | Field et al. | 15/50.1 |
| 2004/0187895 | A1 | 9/2004 | Field et al. | 134/26 |
| 2004/0221407 | A1 | 11/2004 | Field et al. | 15/50.1 |
| 2005/0217062 | A1 | 10/2005 | Field | 15/320 |
| 2006/0032519 | A1 | 2/2006 | Field | 15/320 |

FOREIGN PATENT DOCUMENTS

| | | |
|---|---|---|
| EP | 1 044 645 A2 | 10/2000 |
| JP | 11216092 | 8/1999 |
| WO | WO 95/09557 | 4/1995 |
| WO | WO 00/35333 | 6/2000 |
| WO | WO 02/05047 | 1/2002 |
| WO | WO 02/06435 | 1/2002 |

OTHER PUBLICATIONS

Discover Magazine, Jun. 2002, including cover, Table of Contents, and pp. 26 and 27.

* cited by examiner

CLEANING SYSTEM UTILIZING PURIFIED WATER

CROSS-REFERENCE TO RELATED APPLICATION

This claims the benefit of U.S. Provisional Application Ser. No. 60/643,933 filed Jan. 13, 2005; this application is also a Continuation-in-Part of U.S. application Ser. No. 10/152,549, filed May 21, 2002 now U.S. Pat. No. 7,051,399 and entitled "CLEANER CARTRIDGE", which in turn is a Continuation-in-Part of application Ser. No. 10/026,411, now U.S. Pat. No. 6,585,827 filed Dec. 21, 2001, which in turn claims priority to U.S. Provisional Application Ser. No. 60/308,773 filed Jul. 30, 2001; and this application is a Continuation-in-Part of U.S. application Ser. No. 10/653,347 filed Sep. 2, 2003 now abandoned, which in turn is a Continuation-in-Part of application Ser. No. 10/152,537, now U.S. Pat. No. 6,671,925 filed May 21, 2002, application Ser. No. 10/328,516,now U.S. Pat. No. 6,705,332 filed Dec. 23, 2002 and application Ser. No. 10/143,582, now U.S. Pat. No. 6,735,811 filed May 9, 2002, which is a Continuation-in-Part of application Ser. No. 10/026,411, now U.S. Pat. No. 6,585,827 filed Dec. 21, 2001.

FIELD OF THE INVENTION

The present invention relates to cleaning systems, and, more particularly, to a cleaning system that utilizes purified water.

BACKGROUND OF THE INVENTION

Surface cleaning operations are conducted daily to maintain cleanliness in industrial, commercial and public buildings, such as in restrooms. Such cleaning operations generally involve applying a cleaning liquid to various surfaces of the room.

The systems used in such cleaning operations typically apply the cleaning liquid at high volumes and high pressures. The high volume of cleaning liquid results in long drying times of the surfaces. The high pressures at which the cleaning liquid is applied makes it difficult to control where the cleaning liquid is applied due to splattering. Additionally, the high pressure spray of the cleaning liquid can damage certain surfaces.

Typical cleaning liquids include non-purified water containing hard minerals such as iron and manganese (i.e., hard water). Unless wiped clean of the cleaning liquid, the surfaces can take a long time to dry. Additionally, spots or residue often form on non-wiped surfaces due to the minerals in the water. The existence of residue following the drying of the cleaning liquid is also the result of the use of a large volume of cleaning agent in the cleaning liquid.

The discussion above is merely provided for general background information and is not intended to be used as an aid in determining the scope of the claimed subject matter.

SUMMARY OF THE INVENTION

The present invention is generally directed to a surface cleaning system and method of cleaning a surface utilizing purified water. The system includes a supply of purified water, a supply of cleaning agent, a mixing junction, and a distributor. The mixing junction is configured to combine a flow of the purified water and a flow of the cleaning agent and output a flow of cleaning liquid comprising the flows of the purified water and the cleaning agent. The distributor includes an output through which the cleaning liquid can be discharged.

In the method, flows of purified water and cleaning agent are provided. The flow of purified water and the flow of cleaning agent are mixed to form a flow of cleaning liquid. The flow of cleaning liquid is then discharged to the surface.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
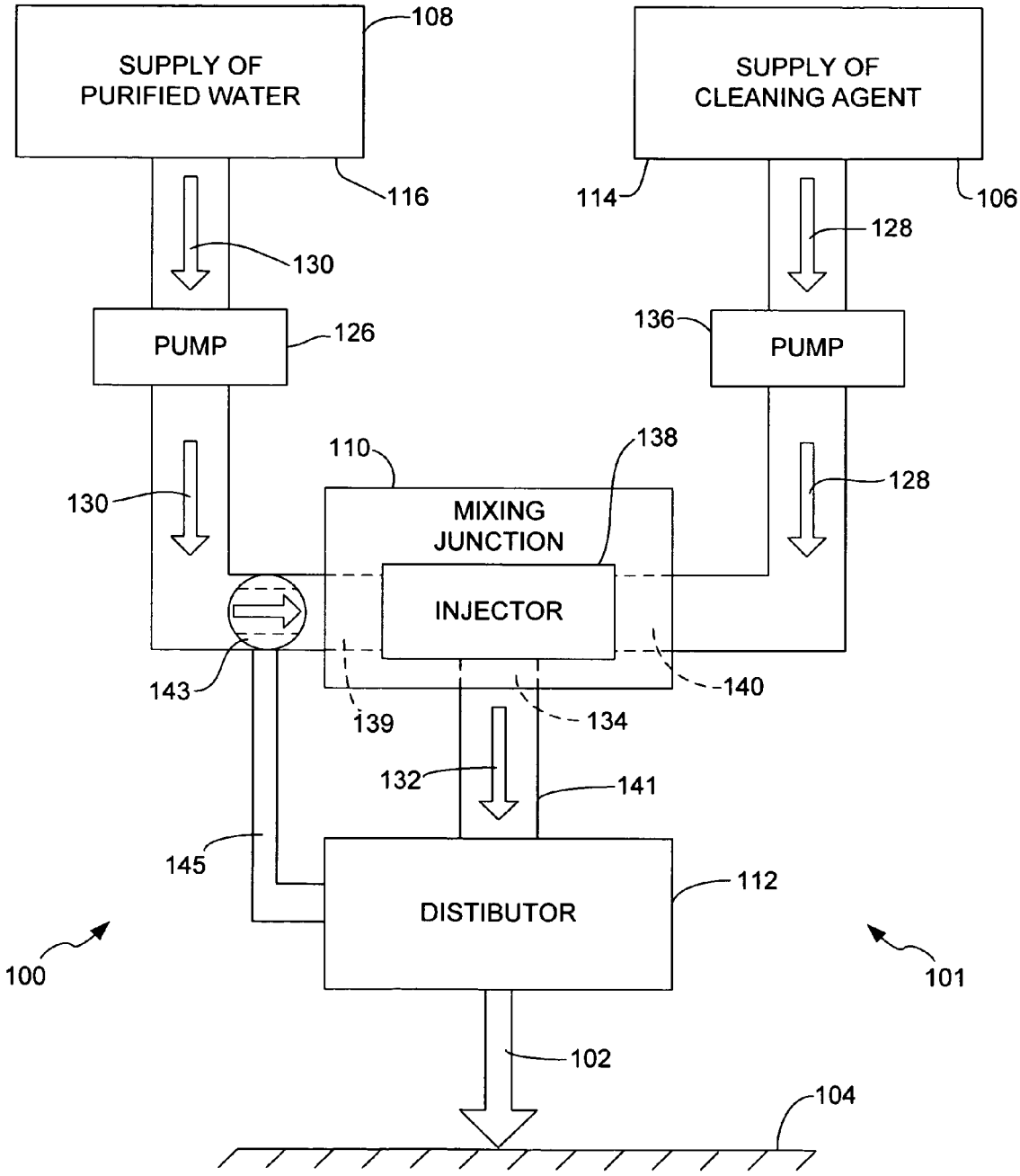
FIG. 1 is a block diagram of a cleaning system in accordance with embodiments of the invention.

FIG. 1 is a block diagram of a cleaning system 100 in accordance with embodiments of the invention. The system 100 generally includes a cleaning liquid dispenser 101 that operates to form and dispense a flow of cleaning liquid (indicated by arrow 102) to a desired surface 104, such as a wall, a floor, a mirror, a sink, a toilet, and other surfaces to be cleaned. Embodiments of the flow of cleaning liquid 102 include an aerated or foamed cleaning liquid and substantially non-aerated or non-foamed cleaning liquid. The system 100 generally includes a supply of cleaning agent 106, a supply of purified water 108, a mixing junction 110 and a distributor 112 for discharging the cleaning liquid 102 to the desired surface 104.

The supply of cleaning agent 110 is preferably contained in a container 114. In accordance with one embodiment of the invention, the cleaning agent 106 includes a polymer-based surfactant that cleans, disinfects, and/or removes or dissolves scum, mold, mildew, stains and odors. Additionally, the surfactant is preferably safe for application to fixtures, tiles, chrome, fiberglass, baked enamel, porcelain, vinyl, stainless steel, synthetic marble and other materials.

In addition to including one or more surfactants, the cleaning agent 106 may include builders, solvents, or other components. In accordance with one embodiment, the cleaning agent 110 includes an anionic surfactant, a non-anionic surfactant, a cationic surfactant, or a combination thereof. A particularly preferred surfactant is DETERIC CP-Na-38 manufactured by DeForest Enterprises, Inc. of Boca Raton, Fla. In accordance with one embodiment, the cleaning agent 110 is in a concentrated form (e.g., more than 30% solids).

One embodiment of the cleaning agent container 114 is a removable container or cartridge that can be replaced as needed. In accordance with one embodiment of the invention, the container 114 is configured to collapse as the cleaning agent 106 contained therein is removed. This avoids a need to ventilate the container, which could give rise to leaks and cause the cleaning agent to dry out. In accordance with one embodiment of the invention, the container 114 is a collapsible bag that can be contained in a cleaning agent cartridge or housing. One example of such a cartridge is described in U.S. patent application Ser. No. 10/152,549, which is assigned to Tennant Company of Minneapolis, Minn.

Embodiments of the supply of purified water include deionized water, distilled water, and/or filtered water, in which hard minerals (e.g., iron and manganese) have been removed or significantly reduced relative to tap water. In one embodiment, the supply of purified water 108 is contained in a tank or container 116 (i.e., onboard supply) of the system 100. In one embodiment, the supply 108 is contained in a removable container.

Figure 2:
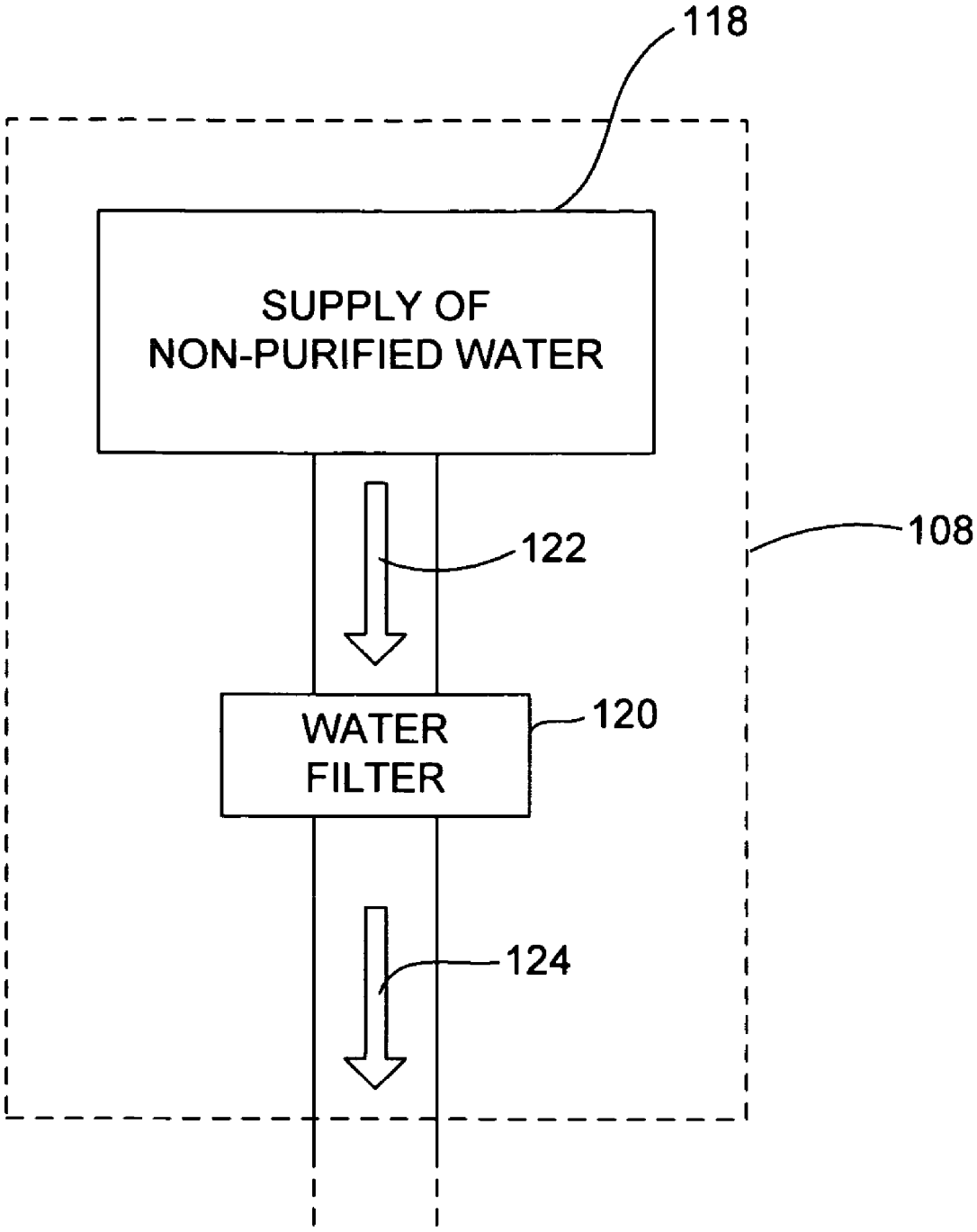
FIG. 2 is a block diagram of a supply of purified water in accordance with embodiments of the invention.

Referring now to the block diagram of FIG. 2, other embodiments of the supply of purified water 108 include a supply of non-purified water 118 and a water filter 120. A flow 122 of the non-purified water is driven through a water filter 120 to produce a flow of purified water 124 and, thus, the supply of purified water 108.

In one embodiment, the supply of non-purified water 118 is contained in a tank or container of the system 100. In another embodiment, the supply of non-purified water 118 is provided from a line source, such as a faucet. In such case, the pressure from the line source can be used to drive the flow of non-purified water 122 through the water filter 120. Alternatively, a pump, such as pump 126 (FIG. 1) can be used to drive the flow of non-purified water 122 through the water filter 120.

The water filter 120, operates to remove hardness minerals (e.g., iron and manganese) from 3 to 50 grains per gallon (gpg) or 51.3 to 855 milligrams per liter (mg/l). The filter 120 can include filtering elements such as ceramic, glass fiber, hard-block carbon, and/or other water-filtering materials.

The mixing junction 110 receives a flow 128 of the cleaning agent 106 and a flow 130 of the purified water 108. The mixing junction generally operates to mix the flows of the cleaning agent 128 and the purified water 130 at a predetermined ratio to form a cleaning liquid 132, a flow of which is discharged through an output 134. The cleaning liquid 132 is provided to the distributor 112, which discharges the flow of cleaning liquid 102 to the desired surface 104.

In one embodiment, the flow of cleaning liquid 132 is at a relatively low pressure as compared to pressurized power washers that operate at pressures from two hundred to over one thousand pounds per square inch (psi). In one embodiment, the pressure at which the flow of cleaning liquid 132 or 102 is discharged from the distributor 112 is less than 40 psi. In another embodiment, the pressure at which the flow of cleaning liquid 132 or 102 is discharged from the distributor 112 is less than 20 psi.

In accordance with one embodiment, the mixing junction 110 combines the flows of cleaning agent 128 and purified water 130 at a desired ratio. Embodiments of the ratio include 1000 parts purified water to approximately 1 part cleaning agent (i.e., 1000:1), 800 parts purified water to approximately 1 part cleaning agent (i.e., 800:1), 400 parts purified water to approximately 1 part cleaning agent (i.e., 400:1), and 100 parts purified water to approximately 1 part cleaning agent (i.e., 100:1). Accordingly, embodiments of the resultant cleaning liquid 102 or 132 is formed of less than 1.0% cleaning agent 106 and, preferably approximately 0.1% cleaning agent 106. As a result, the cleaning liquid 102 leaves very little cleaning agent residue following its application to a surface, such as surface 104. Additionally, the cleaning liquid 102 produces very little chemical waste, and increases the life of the supply of cleaning agent 106.

In one embodiment, the flow of cleaning agent 128 is in a range of approximately 10.0 cubic centimeters per minute (cc/min.) to 0.5 cc/min. In one embodiment, the flow of purified water 130 is less than 0.9 liters per minute (l/min.). In another embodiment, the flow of purified water 130 is less than 0.5 l/min and greater than approximately 0.2 l/min.

Many different methods can be used to control of the dosing of the cleaning agent flow 128 into the flow of purified water 130 at any of the desired ratios or rates provided above. In one embodiment, the system 100 includes the pump 126 to drive the flow of purified water 130 and a pump 136 to drive the flow of cleaning agent 128, as shown in FIG. 1. The regulation of the flows 128 and 130 can be controlled through the pulsing of the pumps 126 and 136 by a suitable controller, valves and/or other flow control devices.

In accordance with another embodiment, the mixing junction 110 includes an injector 138, such as a venturi injector, that injects the flow of cleaning agent 128 into the flow of filtered water 130 at the desired dosage or flow rate. One exemplary injector 138 is the 50580 siphon produced by Spraying Systems Company of Wheaton, Ill. In accordance with this embodiment, the system includes the pump 126 to drive the flow of purified water 130 through an input port 139 of the injector, which generates a pressure drop across an in input port 140. The vacuum produced by the pressure drop at the port 140 operates to drive or suck the flow of cleaning agent 128 into the mixing junction 110 through the port 140 without the need for the depicted pump 136.

In one embodiment, the pump 126 operates to drive the flow of purified water at a low pressure. In one embodiment, the pressure at the outlet of the pump 126 is less than approximately 40 psi. In another embodiment, the pressure at the outlet of the pump is less than 20 psi.

Embodiments of the distributor 112 include nozzles, wands and other hand-held liquid distributors or sprayers, tubing, conduit, and other components for delivering liquids. In one embodiment, a fluid flow path 141 couples the distributor to the mixing junction 110. In one embodiment, the fluid flow path 141 comprises tubing or conduit that allows the operator to discharge the flow of cleaning liquid 102 to a surface 104 that is remote from the mixing junction 110. In one embodiment, the distributor includes a valve that can be actuated by a trigger or other means to allow or prevent the discharge of the flow of the cleaning liquid 102.

Another embodiment of the system 100 or the cleaning liquid dispenser 101 includes the ability to supply only purified water to the distributor for application to the surface 104. In one embodiment, the flow of cleaning agent 128 is blocked from entering the mixing junction 110 using a valve or other suitable component to allow only the flow of purified water 130 to pass through the mixing junction 110 and on to the distributor 112. In another embodiment, a valve 143 operates to either provide the flow of purified water 130 to the mixing junction, as shown in FIG. 1, or bypass the mixing junction 110 and direct the flow of purified water 130 through flow path 145 to the distributor 112 or other a separate distributor. The actuation of the valve 143 can be actuated in accordance with conventional methods.

Figure 3:
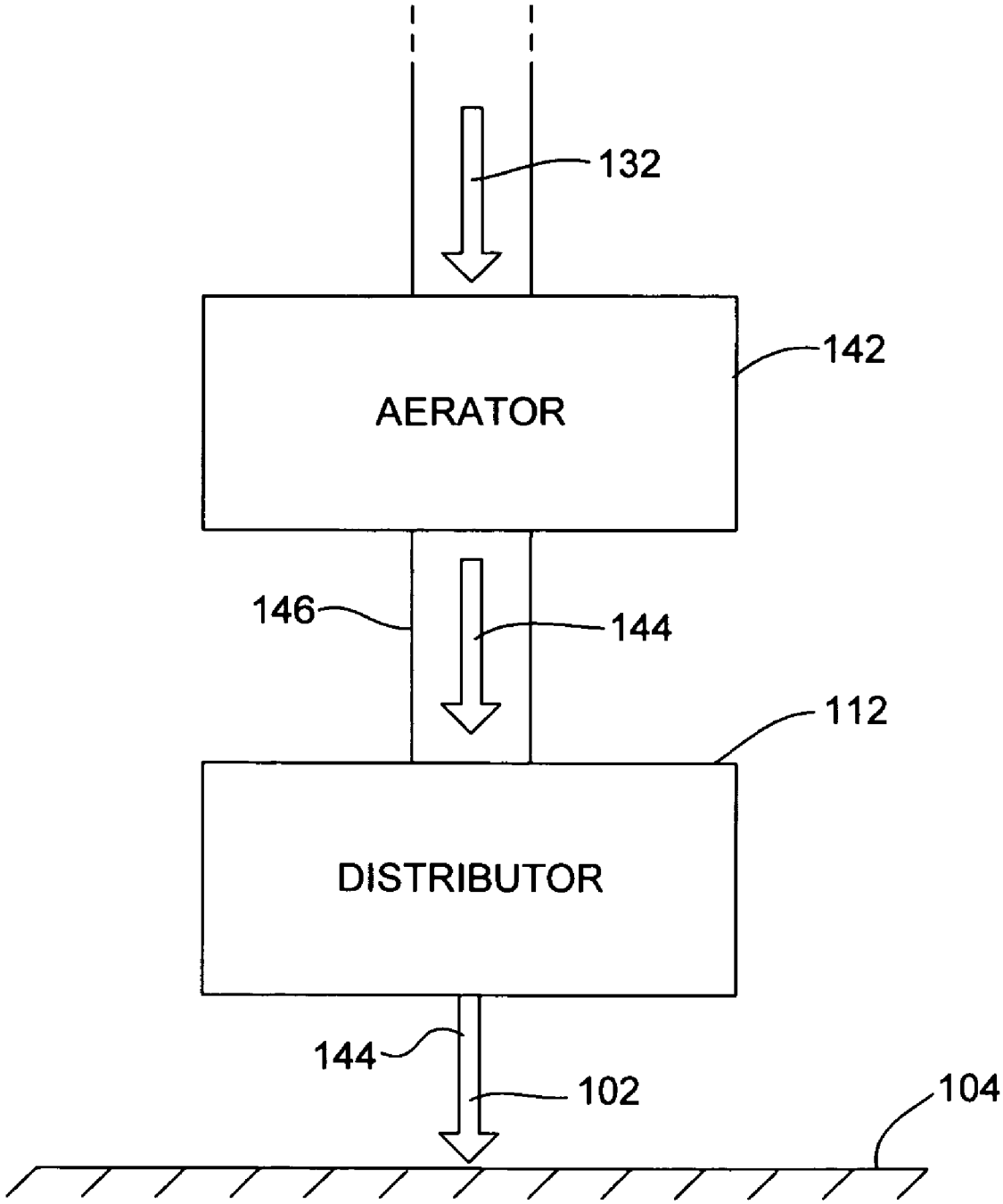
FIG. 3 is a partial block diagram of the cleaning system in accordance with embodiments of the invention.

In accordance with one embodiment, the system 100 includes an aerator 142, as shown in the partial block diagram of system 100 provided in FIG. 3. The aerator generally operates to aerate the flow of cleaning liquid 132 to produce a flow of foamed cleaning liquid 144. In one embodiment, the aerator 142 is configured to receive the output flow of cleaning liquid 132 and aerate the cleaning liquid 132 to produce the output flow of foamed cleaning liquid 144.

The application of foamed cleaning liquid has several advantages over non-foamed cleaning liquid. Exemplary advantages of the foamed cleaning liquid include improved encapsulation of debris on the surface for improved cleaning performance without scrubbing or wiping, efficient use of cleaning agent, improved visibility of the cleaning liquid on the surface and other advantages. Additionally, foamed cleaning liquid will not run down vertical surfaces or drip off edges as freely as non-foamed cleaning liquid. The use of the foamed cleaning liquid provides the operator with improved control over the application of the cleaning liquid for efficient application to the desired surfaces while avoiding excessive application problems of non-foamed cleaning liquids, which results in additional cleanup and produces excess waste.

In one embodiment, the distributor 112 is positioned downstream of the aerator 142 relative to the flow of the foamed cleaning liquid 144. In one embodiment, the flow of the foamed cleaning liquid 144 travels through a fluid flow path, such as fluid flow path 146, to the distributor 112, which directs the flow of foamed cleaning liquid 144 to the surface 104, as illustrated in FIG. 3.

In accordance with another embodiment, the aerator 142 includes at least one aerating nozzle that is configured to inject air into the flow of cleaning liquid 132. One example of a suitable nozzle 150 is the "FoamJet" nozzle (also designated as FJP-20015-CE) produced by Spraying Systems Company of Wheaton, Ill.

Figure 4:
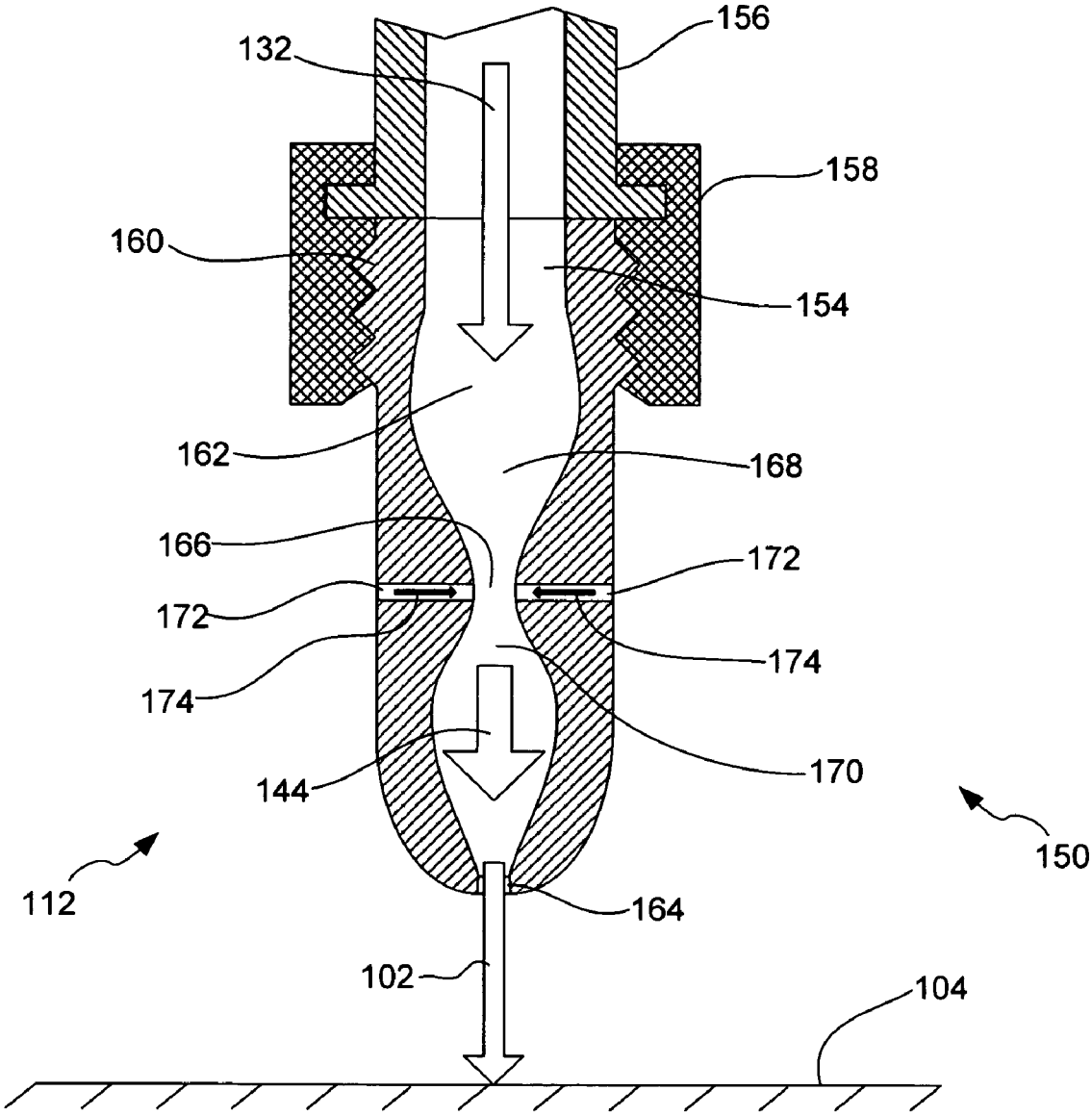
FIG. 4 is a simplified cross-sectional view of an exemplary aerating nozzle in accordance with embodiments of the invention.

FIG. 4 is a simplified cross-sectional view of an exemplary aerating nozzle 150, in accordance with embodiments of the invention. Embodiments of the nozzle 150 include a nozzle body 152 having an inlet 154 configured to receive the flow of cleaning liquid 132 from the output 134 of the mixing junction 110 through, for example, tubing 156 or other fluid flow path. A suitable fitting 158 can connect to nozzle 150 at a threaded section 160 to secure the inlet end of the nozzle 150 to the tubing 156. The output flow of cleaning liquid 132 travels through a bore 162 toward an outlet 164 of the nozzle 150. In one embodiment, the bore 162 includes a constricted throat portion 166 having a convergent upstream end 168 and a divergent downstream end 170.

In one embodiment, the nozzle 150 includes one or more gas inlets or radial ports 172 extending through a side of the body 152 to the constricted throat portion 166. Air, represented by arrows 174, is sucked through one or more gas inlets or radial ports 172 in response to a vacuum generated within throat 166 by the flow of cleaning liquid 132 for mixing therewith. The aeration of the cleaning liquid 132 by air induction through the radial ports 172 produces the aerated or foamed cleaning liquid 144 that is discharged through the outlet 164.

In one embodiment, the distributor 112 includes the aerating nozzle 150, as shown in FIG. 4. Accordingly, the flow of foamed cleaning liquid 144 is discharged directly to a desired surface 104 as flow 102.

Figure 5:
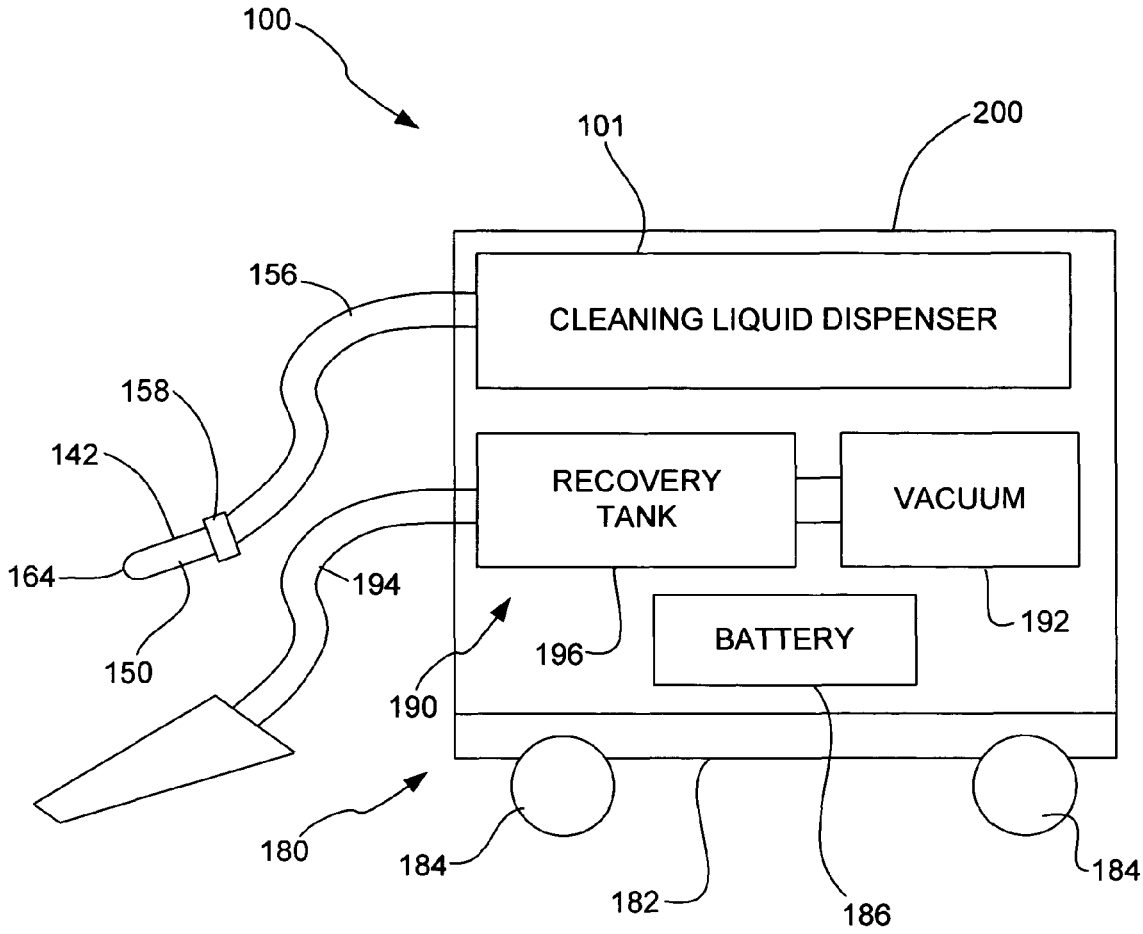
FIG. 5 is a simplified diagram of embodiments of the cleaning system supported on an exemplary mobile body.

One embodiment of the system 100 includes a mobile body that supports at least some of the components of the cleaning liquid dispenser 101 described above to facilitate easy movement of the system 100 to a desired location. FIG. 5 is a simplified diagram of the system 100 that includes an exemplary mobile body 180. Embodiments of the mobile body 180 include a base 182 and two or more wheels 184. At least some of the components of the various embodiments of the cleaning liquid dispenser 101 described above are supported on the mobile body 180 including, for example, an onboard supply of purified water 108, a port for receiving water from an external source (e.g., line source) that is purified using an onboard filter 120 if necessary, an onboard supply of cleaning agent 106, the mixing junction 110, the aerator 142, the pump 126, the pump 136, and/or other components of the system. When the system 100 includes the pump 126 and/or the pump 136, power may be supplied from an external source through suitable cable or from a battery 186.

In one embodiment, the cleaning system 100 includes a vacuumized fluid recovery device 190, a simplified diagram of embodiments of which is shown in FIG. 5. The vacuumized fluid recovery device 190 includes a vacuum 192 that operates to remove soiled cleaning liquid from a surface through a hose 194 and store the recovered soiled cleaning liquid in a recovery tank 196.

In one embodiment, the vacuumized fluid recovery device 190 is supported on the mobile body 180. Embodiments of the system 100 include both the supply of power to the vacuum 192 from either an external source (i.e., not supported by mobile body 180), or from the battery 186, as above with respect to the pumps 126 and 136.

In one embodiment, the system includes a housing 200, shown in FIG. 5, that encloses portions of at least some of the components of the cleaning liquid dispenser 101 of the system 100. In one embodiment, the housing 200 encloses at least a portion of the mixing junction 110 and at least a portion of the distributor extends outside of the housing. For example, when the distributor 112 includes the nozzle 150 and the tubing 156, both the nozzle 150 and a portion of the tubing 156 extend outside of the housing 200.

In one embodiment, the housing 200 encloses the supply of cleaning agent 106, the supply of purified water 108, the pump 126, and the mixing member 110. In one embodiment, the housing 200 has a volume of less than 2.0 cubic feet.

Figure 6:
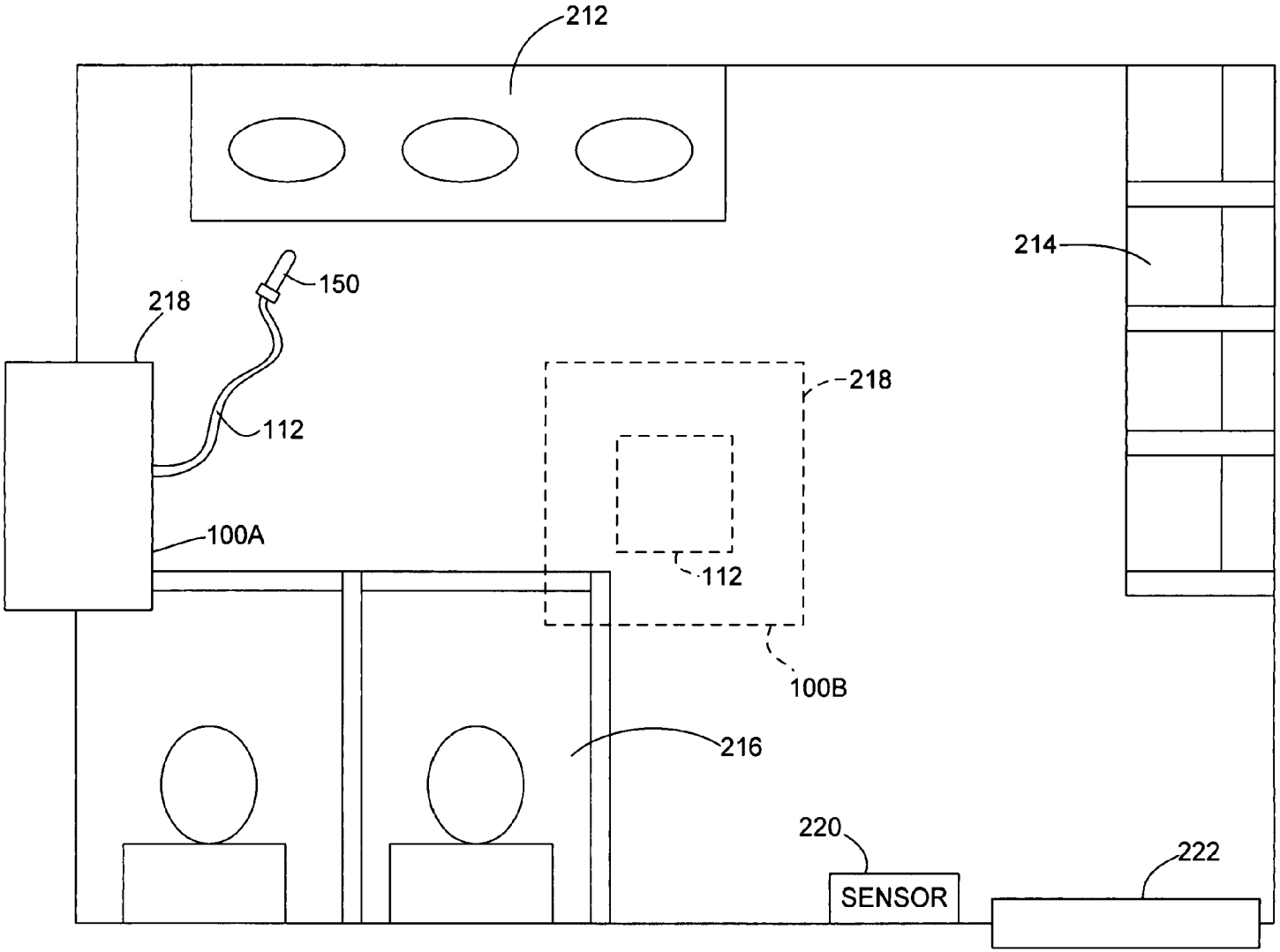
FIG. 6 is a simplified diagram of the cleaning system mounted to a wall or a ceiling of a room in accordance with embodiments of the invention.

In accordance with additional embodiments, at least some of the components of embodiments of the system 100 are attached to a wall (indicated at 100A) or a ceiling (indicated at 100B) in a room, as illustrated in the simplified diagram of a bathroom provided in FIG. 6. In accordance one embodiment, the distributor 112 includes tubing 210 that can be remotely located from the wall or ceiling and allows an operator to discharge the cleaning liquid 102 in either the aerated or non-aerated form to a desired surface of the room. In one embodiment, the tubing 210 is extendable to reach various areas of the room, such as sinks 212, urinals 214, stalls 216 and other areas of the room. After the operator has completed the cleaning operation in the room, one embodiment allows the tubing to be retracted within a housing 218 of the system 200.

In accordance with another embodiment, the system 100 is configured to perform automated cleaning of the room. For example, the distributor 112 can be mounted to the ceiling and configured to apply the cleaning liquid 102 to various surfaces of the room once the system 100 is activated. The distributor 112 can include multiple nozzles, such as nozzle 150, that direct the foamed cleaning liquid 102 as desired, or provide a rotatable nozzle that can be rotated to apply the foamed cleaning liquid 102 to multiple surfaces of the room.

In accordance with this embodiment of the invention, automated cleaning of the room can commence once a suitable sensor 220 determines that the room is unoccupied. Additionally, a locking mechanism can be activated to lock the door 222 to the room and prevent people from entering the room during a cleaning operation. In accordance with another embodiment of the invention, an automated cleaning operation performed by system 100 in a room can include a rinsing operation in which the purified or filtered water is applied to surfaces of the room following the application of the cleaning liquid 102 to those surfaces.

Additional embodiments of the invention include methods of using the system 100 described above to perform a cleaning operation of a surface. In the method, a flow of purified water (e.g., flow 130) and a flow of cleaning agent (e.g., flow 128) are provided. Next, the flows of purified water and cleaning agent are mixed (e.g., at mixing junction 110) to form a flow of cleaning liquid (e.g., flow 132) that comprises the flows of purified water and cleaning agent. The flow of cleaning liquid is then discharged (e.g., from distributor 112) to a desired surface (e.g., surface 104).

In one embodiment, the flow of cleaning liquid is aerated to produce a foamed cleaning liquid prior to discharging the foamed cleaning liquid to the surface.

Another embodiment of the method includes applying the flow of purified water to the surface to rinse the surface.

In accordance with one embodiment of the method, the flow of purified water is provided by driving a flow of non-purified water (e.g., flow 122) through a water filter (e.g., water filter 120) that responsively outputs the flow of purified water.

In another embodiment of the method, the flow of purified water and the flow of cleaning agent is provided in accordance with the flow rates discussed above. Similarly, embodiments of the method include forming the cleaning liquid of the purified water and cleaning agent at the ratios discussed above and discharging the cleaning liquid at the pressures discussed above.

In one embodiment, the cleaning liquid is allowed to dry on the surface without wiping. The low volume of cleaning liquid results in fast drying times. The drying time is further decreased by the use of the purified water and, in one embodiment, the aeration of the cleaning liquid. Additionally, any residue that remains on the surface following the drying of the surface is very small and generally unnoticeable due to the use of the purified water and the low volume of cleaning agent.

The cleaning system of the present invention provides advantages over systems using non-purified water. First, the use of purified water in combination with very small amounts of cleaning agent leaves very little residue on the surface to which it is applied after it is allowed to dry without wiping or rinsing the surface. The small volume of cleaning liquid that is applied to the surface also decreases the drying time relative to systems that apply a higher volume of cleaning liquid.

The aerated form of the cleaning liquid further decreases the drying time by allowing for further decreases to the amount of water in the cleaning liquid. Additionally, the bubbles in the foamed cleaning liquid perform a "scrubbing" function on the surface it is applied to automatically thereby performing a cleaning operation without the need for additional scrubbing to be performed by the operator of the system 100.

Although the present invention has been described with reference to preferred embodiments, workers skilled in the art will recognize that changes may be made in form and detail without departing from the spirit and scope of the invention. For example, multiple cleaning agents can be used with the system 100 to provide different cleaning functions, such as a rinsing agent for performing a rinsing operation, a sterilizing agent for performing a sterilizing operation, and other cleaning operations.

What is claimed is:

1. A surface cleaning system comprising:

a mobile body comprising wheels;

a water tank supported on the mobile body, the water tank containing a supply of non-purified water containing dissolved minerals;

a water filter supported on the mobile body, wherein the water filter receives a flow of the non-purified water from the water tank, removes the dissolved minerals from the flow of non-purified water and discharges the flow of filtered non-purified water as a flow of purified water;

a distributor having an output, wherein the distributor discharges a flow of cleaning liquid comprising the flow of purified water through the output;

a recovery tank separate from the water tank; and a vacuumized fluid recovery device configured to remove soiled cleaning liquid from the surface and store the soiled cleaning liquid in the recovery tank.

2. The system of claim 1, further comprising:

a container supported on the mobile body;

a supply of cleaning agent in the container; and a mixing junction supported on the mobile body receives the flow of purified water through a first fluid flow path connected to the water tank, receives a flow of the cleaning agent from the container through a second fluid flow path, and outputs the flow of purified water and the flow of the cleaning agent to the distributor;

wherein the flow of cleaning liquid comprises the flow of purified water and the flow of the cleaning agent output from the mixing junction.

3. The system of claim 1 further comprising a pump configured to drive the flow of the non-purified water through the water filter.

4. The system of claim 2, further comprising an aerator configured to aerate the flow of cleaning liquid to thereby form a foamed cleaning liquid, wherein the distributor is configured to discharge the foamed cleaning liquid through the output.

5. The system of claim 2, wherein the flow of the purified water is less than approximately 0.9 liters/min.

6. The system of claim 2, wherein the flow of purified water is less than approximately 0.5 liters/min.

7. The system of claim 2, wherein the flow of the cleaning agent is less than 10 cc/min.

8. The system of claim 2, wherein the flow of cleaning liquid comprises a ratio of purified water to cleaning agent of X:1, wherein X is greater than 400.

9. The system of claim 8, wherein X is greater than 800.

10. The system of claim 2 further comprising a housing enclosing at least a portion of the mixing junction; wherein the distributor includes a portion that extends outside the housing, the portion having an end connected to the output.

11. The system of claim 2 wherein the distributor comprises a nozzle mounted to the end of a section of tubing, wherein the nozzle includes an aerator configured to aerate the flow of cleaning liquid to thereby form a flow of foamed cleaning liquid.

12. A cleaning system comprising:

a line source of non-purified water containing dissolved minerals;

a water filter, wherein the water filter receives a flow of the non-purified water at an input port coupled to the source of non-purified water, removes the dissolved minerals from the flow, and discharges a flow of the filtered non-purified water as a flow of purified water through an output port;

a first fluid flow path connected to the output port of the water filter;

a container containing a supply of cleaning agent;

a second fluid flow path connected to the container;

a mixing junction coupled to the first and second fluid flow paths, wherein the mixing junction combines the flow of purified water from the first fluid flow path with a flow of the cleaning agent from the second fluid flow path and outputs a flow of cleaning liquid comprising the flows of purified water and cleaning agent;

a distributor that discharges the flow cleaning liquid through the output; and a housing enclosing at least a portion of the mixing junction, wherein the housing is mounted to one of a wall of a room and a ceiling of a room;

wherein the flow of the filtered water is less than approximately 0.9 liters/min.

13. The system of claim 12, wherein the flow of cleaning liquid comprises a ratio of purified water to cleaning agent of X:1 wherein X is greater than 400.

14. The system of claim 1, wherein the dissolved minerals comprise elements-selected from the group consisting of iron and manganese.

15. The system of claim 1, wherein the filter comprises filtering elements selected from the group consisting of ceramic, glass fiber and hard-block carbon.

16. The system of claim 14, wherein the dissolved minerals comprise elements selected from the group consisting of iron and manganese.

17. The system of claim 12, wherein the housing is mounted to the ceiling of a room.

18. The system of claim 12, wherein the housing is mounted to the wall of a room.

* * * * *